US006802390B2

(12) United States Patent
Peterson et al.

(10) Patent No.: US 6,802,390 B2
(45) Date of Patent: Oct. 12, 2004

(54) SAFETY LINE ANCHORAGE METHODS AND APPARATUS

(75) Inventors: Gregory K. Peterson, Springwood (AU); Russell I. Moy, Leesburg, VA (US); Paul Vong, Parramatta (AU)

(73) Assignee: Capital Safety Group (Australia) Pty Limited, Sydney (AU)

( * ) Notice: Subject to any disclaimer, the term of this patent is extended or adjusted under 35 U.S.C. 154(b) by 0 days.

(21) Appl. No.: 10/453,352

(22) Filed: Jun. 3, 2003

(65) Prior Publication Data

US 2003/0192739 A1 Oct. 16, 2003

Related U.S. Application Data

(62) Division of application No. 10/026,926, filed on Dec. 19, 2001, now Pat. No. 6,604,605.
(60) Provisional application No. 60/261,072, filed on Jan. 11, 2001.

(51) Int. Cl.[7] ..... E04G 3/14
(52) U.S. Cl. ..... 182/36; 182/3
(58) Field of Search ..... 182/36, 3; 104/111, 104/112, 115, 89, 93; 248/218.4, 219.4

(56) References Cited

U.S. PATENT DOCUMENTS

| | | | | | |
|---|---|---|---|---|---|
| 3,313,567 | A | * | 4/1967 | Sturman | 293/137 |
| 4,289,043 | A | * | 9/1981 | Chabre et al. | 74/609 |
| 5,718,095 | A | * | 2/1998 | Kemeny | 52/698 |
| 5,979,599 | A | | 11/1999 | Noles | 182/36 |
| 6,217,090 | B1 | * | 4/2001 | Berzinji | |

FOREIGN PATENT DOCUMENTS

| | | | | |
|---|---|---|---|---|
| DE | 299 05 756 U | | 8/2000 | |
| DE | 29905756 U1 | * | 8/2000 | A62B/35/00 |
| EP | 0 129 241 | | 12/1984 | |
| WO | WO 99 22816 A | | 5/1999 | |

* cited by examiner

*Primary Examiner*—Alvin C. Chin-Shue
(74) *Attorney, Agent, or Firm*—IPLM Group, P.A.

(57) ABSTRACT

An anchorage assembly (100) is interconnected between a support structure (90) and a safety line (160, 161). The anchorage assembly (100) routes the safety line (160, 161) about a corner and accommodates passage of a slotted coupling device movably mounted on the safety line (160, 161).

5 Claims, 2 Drawing Sheets

SAFETY LINE ANCHORAGE METHODS AND APPARATUS

This application is a divisional application of U.S. patent application Ser. No. 10/026,926 filed Dec. 19, 2001 now U.S. Pat. No. 6,604,605, which claims benefit of U.S. Provisional Application Serial No. 60/261,072, filed Jan. 11, 2001.

BACKGROUND OF THE INVENTION

1. Field of the Invention

The present invention relates to methods and apparatus for anchoring an intermediate portion of a safety line relative to a support structure while accommodating passage of a coupling device that is movably mounted on the line.

2. Description of the Prior Art

Most people who engage in activities at dangerous heights recognize the desirability of anchoring themselves relative to a support structure to reduce the likelihood or magnitude of injury in the event of a fall. One widely accepted fall arrest system includes at least one horizontal safety line that is connected to the support structure at intermittent locations by means of brackets. At least one coupling device may be mounted on the line and movable both along the line and past the brackets without compromising the connection therebetween. As a result, a person may tether himself to the coupling device and travel along the safety line with relative freedom and safety. Examples of some known systems are disclosed in U.S. Pat. No. 5,343,975 to Riches et al.; U.S. Pat. No. 5,279,385 to Riches et al.; U.S. Pat. No. 5,224,427 to Riches et al.; and U.S. Pat. No. 4,790,410 to Sharp et al.

The foregoing patents disclose horizontal safety line systems which are advantageous in many respects and/or situations. Among other things, the line supporting brackets are designed to deform in the event of a fall, thereby absorbing energy and/or indicating that the bracket has been subjected to a significant load. Also, a plurality of these brackets may be arranged to guide a safety line about corners and/or obstacles. Despite such advances, there is still room for additional options and/or improvements in the field of safety line anchorage systems and/or certain applications within the field.

SUMMARY OF THE INVENTION

The present invention provides an anchorage assembly that supports an intermediate portion of a safety line and accommodates passage of a slotted coupling device movably mounted on the safety line. The anchorage guides the safety line about a corner of a support structure and provides desirable energy absorbing characteristics, as well. On a preferred embodiment, multiple plates are interconnected in series between a support structure and support brackets for the safety line. Energy absorbing spacers are disposed between the support structure and the adjacent plate, as well as between two adjacent plates. The assembly is constructed so that the spacers are the first components to deform in the event of a fall. Many features and/or advantages of the present invention will become more apparent from the detailed description which follows.

BRIEF DESCRIPTION OF THE DRAWINGS

With reference to the Figures of the Drawing, wherein like numerals represent like parts throughout the several views.

DETAILED DESCRIPTION OF THE PREFERRED EMBODIMENT

Figure 1:
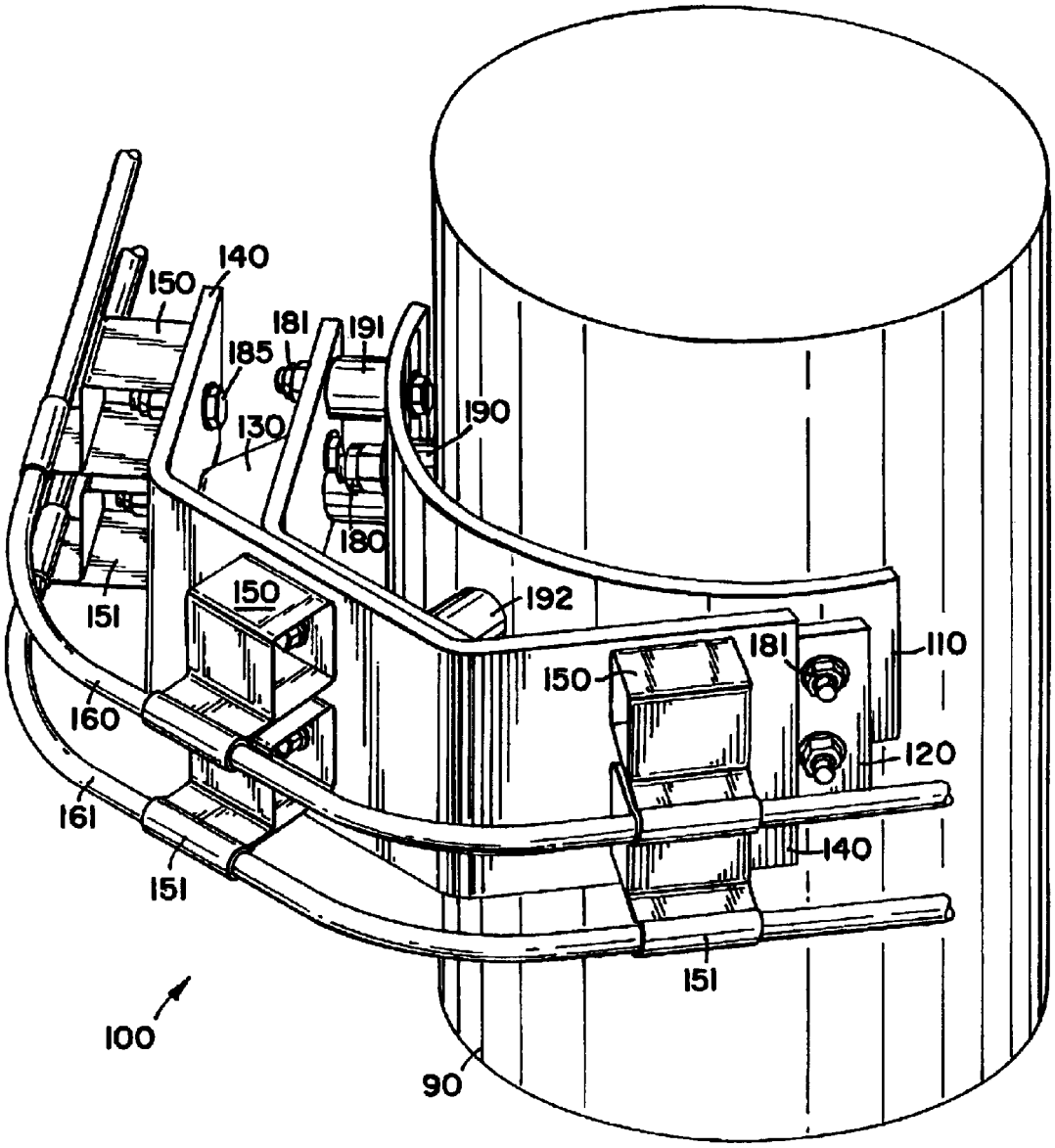
FIG. 1 is a fragmented, perspective view of an anchorage assembly constructed according to the principles of the present invention.
Figure 2:
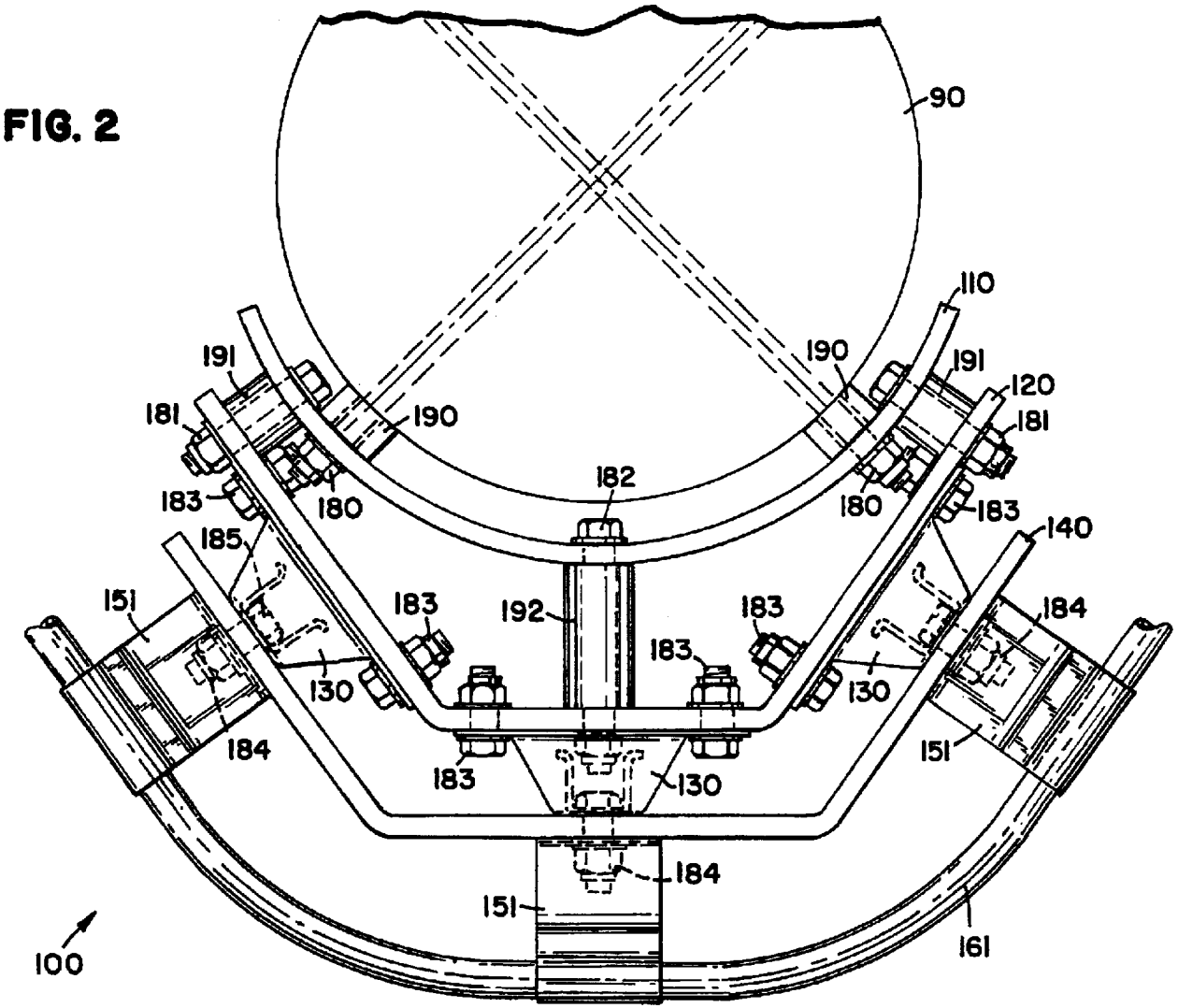
FIG. 2 is a bottom view of the anchorage assembly of FIG. 1.

A preferred anchorage system constructed according to the principles of the present invention is designated as 100 in FIGS. 1–2. Generally speaking, the system 100 is connected to a support structure 90 and supports at least one safety line 160, 161. Among other things, the system 100 is suitable for use as a component in horizontal safety line systems like those disclosed in U.S. Pat. No. 5,343,975 to Riches et al.; U.S. Pat. No. 5,279,385 to Riches et al.; U.S. Pat. No. 5,224,427 to Riches et al.; and U.S. Pat. No. 4,790,410 to Sharp et al., all of which are incorporated herein by reference.

As shown in FIG. 2, the system 100 includes a first curved plate 110 having an arcuate profile when viewed from below. The profile is preferably configured to match or conform to the exterior of the support structure, which is depicted as a cylindrical post 90. Each end of the plate 110 is secured to the post 90 by means of a respective fastener designated as 180 (and including a mating nut and bolt). Each associated bolt extends through a respective hole in the plate 110 and through a respective member 190, which preferably functions as both a spacer and an energy absorber. The respective holes in the plate 110 are offset vertically relative to one another to avoid interference between the respective bolts in the region of their intersection inside the post 90.

As shown in FIG. 2, a second curved plate 120 has a somewhat U-shaped profile when viewed from below. However, the opposite distal ends of the plate 120 extend in divergent fashion and preferably define an angle equal to the change in direction experienced by the safety line 160, 161 (approximately 110° on the depicted embodiment 100). Each distal end of the second plate 120 is secured to a respective end of the first plate 110 by means of a respective fastener 181 (including a mating nut and bolt). Each associated bolt extends through aligned holes in the plates 110 and 120, and through a respective member 191 disposed between the plates 110 and 120. An intermediate segment of the second plate 120 is similarly connected to an intermediate portion of the first plate 110, with a relatively longer member 192 disposed therebetween, and a relatively longer fastener 182 (including a mating nut and bolt) inserted through the member 192 and interconnected between the plates 110 and 120. Like the members 190, the members 191 and 192 preferably function both as spacers and as energy absorbers.

As shown in FIG. 2, a third curved plate 140 has a profile comparable to that of the second plate 120. Each distal end of the third plate 140 is secured to a respective end of the second plate 120 by means of a bowl-shaped bracket 130 disposed therebetween. At each end, fasteners 183 (including mating nuts and bolts) are interconnected between the second plate 120 and a rim portion of a respective bracket 130, and a fastener 184 (including a mating nut and bolt) is interconnected between the third plate 140 and a base portion of a respective bracket 130.

Each fastener 184 also secures a respective bracket 151 to the plate 140. The plate 140 is relative taller than the plate 120, in order to accommodate the second set of brackets 150, which are secured in place by respective fasteners 185. However, the present invention is not limited to any particular number of safety lines. The brackets 150 and 151 and the safety lines 160 and 161 are identical to those disclosed in U.S. Pat. No. 5,343,975 to Riches et al., except that the brackets 150 and 151 are relatively more rigid and preferably made of stainless steel. Also, the system 100 is constructed so that the members 190–192 are the first, and ideally the only, components to deform in response to a fall or any comparable load on either line 160 or 161. In this regard, the plates 110, 120, and 140 are also preferably stainless steel, whereas the members 190–192 are comparable to #40 engine block mounts made by McKay Industries in Australia. As a result, replacement of the brackets 150 and 151 (and the associated hassles) is a less frequent concern.

Those skilled in the art will recognize that the system 100 may alternatively be constructed with brackets that are designed to deform. In other words, deformable brackets identical to those disclosed in U.S. Pat. No. 5,343,975 to Riches et al. may be used in the system 100 to provide an alternative system where the line supporting brackets are the first components to deform.

In yet another alternative arrangement, otherwise deformable brackets, like those disclosed in U.S. Pat. No. 5,343,975 to Riches et al., may be modified or reinforced to resist deformation. For example, reinforcing plates may be interconnected between the brackets 150 and 151 and the plate 140. The plates are preferably configured to match the profile of the brackets 150 and 151 (including the relatively thin neck portion but not the tubular line supporting portion). The plates 170 are preferably made of stainless steel and welded to both the brackets 150 or 151 and the plate 140. With the addition of the plates, the members 190–192 would, once again, be the first components of the system to deform.

The present invention also provides various methods which may be performed in assembling and/or using the system 100. This disclosure will enable others to realize various embodiments and/or applications. Therefore, although the present invention is described with reference to a preferred embodiment and a particular application, the scope of the present invention should be limited only to the extent of the following claims.

What is claimed is:

1. In combination, a support structure having a corner, a horizontal safety line supported by at least three brackets, and an anchorage assembly interconnected between the brackets and the support structure, the anchorage assembly comprising:

at least one plate configured to curve about the corner of the support structure with a first end of the plate extending in a first direction and a second end of the plate extending in a discrete and non-parallel, second direction, wherein a first one of the brackets is supported proximate the first end of the plate, and a second one of the brackets is supported proximate the second end of the plate, and a third one of the brackets is supported proximate an intermediate portion of the plate; and a first energy absorber secured between the support structure and the first end of the plate, and a second energy absorber secured between the support structure and the second end of the plate, wherein the at least one plate includes a first curved plate and a second curved plate, and additional energy absorbers are secured therebetween.

2. The combination of claim 1, wherein at least one said curved plate is a continuously arcuate segment, and at least one other said curved plate is comprised of multiple flat segments.

3. In combination, a support structure having a corner, a horizontal safety line supported by at least three brackets, and an anchorage assembly interconnected between the brackets and the support structure, the anchorage assembly comprising:

a first curved plate, a second curved plate, and a third curved plate, wherein the second curved plate is secured between the first curved plate and the third curved plate, and each said curved plate is configured to curve about the corner of the support structure with a first end extending in a first direction and a second end extending in a discrete, second direction, wherein a first one of the brackets is secured to the third curved plate proximate the first end, and a second one of the brackets is secured to the third curved plate proximate the second end, and a third one of the brackets is secured to an intermediate portion of the curved plate;

a first energy absorber secured between the support structure and the first end of the first curved plate, and a second energy absorber secured between the support structure and the second end of the first curved plate; and additional energy absorbers secured between the first curved plate and the second curved plate.

4. The combination of claim 3, further comprising isolation brackets secured between the second curved plate and the third curved plate.

5. The combination of claim 3, wherein at least one said curved plate is arcuate, and at least one said curved plate is comprised of flat segments.

* * * * *